US006667111B2

(12) United States Patent
Sikka et al.

(10) Patent No.: US 6,667,111 B2
(45) Date of Patent: Dec. 23, 2003

(54) RAPID INFRARED HEATING OF A SURFACE

(75) Inventors: Vinod K. Sikka, Oak Ridge, TN (US); Craig A. Blue, Concord, TN (US); Evan Keith Ohriner, Knoxville, TN (US)

(73) Assignee: UT Battelle LLC, Oak Ridge, TN (US)

( * ) Notice: Subject to any disclaimer, the term of this patent is extended or adjusted under 35 U.S.C. 154(b) by 408 days.

(21) Appl. No.: 09/676,167

(22) Filed: Nov. 30, 2000

(65) Prior Publication Data

US 2003/0145679 A1 Aug. 7, 2003

Related U.S. Application Data

(62) Division of application No. 09/268,624, filed on Mar. 15, 1999, now Pat. No. 6,174,388.

(51) Int. Cl.[7] ..... B22F 7/00
(52) U.S. Cl. ..... 428/547; 428/610
(58) Field of Search ..... 428/610, 547; 148/512, 525, 527, 565

(56) References Cited

U.S. PATENT DOCUMENTS

| | | | | |
|---|---|---|---|---|
| 3,765,954 A | * | 10/1973 | Tokuda et al. | |
| 4,027,185 A | | 5/1977 | Nodwell et al. | 313/184 |
| 4,415,833 A | | 11/1983 | Oetken et al. | 313/559 |
| 4,451,302 A | * | 5/1984 | Prescott et al. | 148/224 |
| 4,482,393 A | | 11/1984 | Nishiyam et al. | |
| 4,649,261 A | | 3/1987 | Sheets | 219/390 |
| 4,797,535 A | | 1/1989 | Martin | 219/338 |
| 4,872,926 A | * | 10/1989 | Giacobbe | |
| 4,897,117 A | * | 1/1990 | Penrice | 75/248 |
| 4,937,490 A | | 6/1990 | Camm et al. | 313/12 |
| 4,958,061 A | | 9/1990 | Wakabayashi et al. | 219/411 |
| 4,981,815 A | | 1/1991 | Kakoschke | 437/173 |
| 5,279,973 A | | 1/1994 | Suizu | 437/25 |
| 5,515,336 A | | 5/1996 | Chin et al. | 367/83 |
| 5,536,337 A | * | 7/1996 | Wei | 148/549 |
| 5,561,735 A | | 10/1996 | Camm | 392/416 |
| 5,961,751 A | * | 10/1999 | Maruki et al. | 148/512 |
| 6,143,241 A | * | 11/2000 | Hajaligol et al. | 419/31 |

FOREIGN PATENT DOCUMENTS

| | | |
|---|---|---|
| EP | 0347409 | 12/1989 |
| JP | 16-30367 | 9/1971 |
| RU | 1629329 | 3/1988 |

* cited by examiner

*Primary Examiner*—Ngoclan Mai
(74) *Attorney, Agent, or Firm*—Oscar A. Towler, III; Nexsen Pruet Jacobs & Pollard, LLC

(57) ABSTRACT

High energy flux infrared heaters are used to treat an object having a surface section and a base section such that a desired characteristic of the surface section is physically, chemically, or phasically changed while the base section remains unchanged.

3 Claims, 8 Drawing Sheets

HEATING RATES FOR THE INFRARED METHOD ARE COMPARED WITH INDUCTION AND RESISTIVE HEATING METHODS.

HARDNESS VERSUS DISTANCE PLOT FOR EXTENDO-DIE™ BLOCK AFTER GRADIENT HEATING BY INFRARED SOURCE AND WATER QUENCHING.

HARDNESS VERSUS DISTANCE PLOT FOR EXTENDO-DIE™ BLOCK AFTER GRADIENT HEATING BY INFRARED SOURCE, WATER QUENCHING, AND A TEMPERING TREATMENT AT 585°C FOR 1 H IN AN INFRARED FURNACE.

HEATING RATES FOR THE INFRARED METHOD ARE COMPARED WITH INDUCTION AND RESISTIVE HEATING METHODS.

RAPID INFRARED HEATING OF A SURFACE

This application is a division of application Ser. No. 09/268,624, filed Mar. 15, 1999, U.S. Pat. No. 6,174,388.

The United States Government has rights in this invention pursuant to contract number DE-AC05-96OR22464 between the U.S. Department of Energy and Lockheed Martin Energy Research Corporation.

FIELD OF THE INVENTION

This invention relates to the field of heat treatment of materials, and more particularly to the use of infrared radiation in such heat treatment. More specifically, the current invention relates to the use of very high heat fluxes and heating rates to selectively treat an object.

BACKGROUND OF THE INVENTION

There are numerous fields in which heat is used to transform a characteristic of a material. The application of heat to certain materials, for example plastic resins, increases the plasticity thereof. The controlled application of heat to certain steels, however, can have the opposite effect, increasing the hardness ($R_c$) of the metal.

There are several problems associated with heat treating materials. These problems are often complementary, contradictory, or both. It is necessary at times to provide sufficient heat to transform the desired characteristic of a material while avoiding the application of too much heat. It may be desired, for example, to heat a material enough to make the material plastically deformable without actually melting the material. The amount of heat must be carefully controlled.

The directionality of the heat being used also presents problems. It is sometimes necessary, for example, to treat only a portion or a surface of a body. One current method of achieving this is simply to heat the entire body. This method wastes the majority of the heat generated, costing money and expending resources. Moreover, it is often desired that different portions of the body have different characteristics. Heating the entire body in order to heat only a portion would destroy these differences.

The use of more directionally controllable heating devices, such as gas jets or lasers, also has problems. While these devices can be fairly precisely aimed, the total area being heated at a given time is small. Thus, where an entire surface is to be heated, these devices cannot maintain a steady, even heat over the whole surface.

Another problem with radiant heaters or gas jets is the relatively long amount of time needed to achieve a desired temperature. A primary problem is the cost of the energy being consumed during the heating time. A secondary problem is simply the consumption of time. Moreover, if one of these methods is being used to treat only a portion of a body or surface, the longer time permits the remaining portion to at least approach the final temperature, either through conduction from the portion of interest or directly by the heating means.

Current methods of heating only a portion of a material or body, or of achieving a temperature in only a discrete layer of an object, are wasteful of energy, slow, and inefficient. There is thus room for improvement in the art.

SUMMARY OF THE INVENTION

It is an object of this invention to provide a method of rapidly and efficiently heating a layer of an object.

It is another object of this invention to provide a method of achieving such heating with little or no temperature effect on the remaining layers or portion of the object.

It is a further object of this invention to provide a method of heat treating a surface to effect a change in that surface while leaving an underlying layer or portion unchanged.

These and other objects and advantages are met by providing a process for heat treating an object having a surface section and a base section by the steps of directing infrared radiation toward the surface section at a power density of at least 250 kW/m$^2$ to rapidly heat the surface at a rate of at least 100° C. per minute and shielding the base section from the infrared radiation, the rapid heat causing the surface section to undergo a physical, chemical, or phase change to change a characteristic of the surface section while not changing that characteristic in the base section. The surface section may form the shield for the base section, and the method can be used on monolithic, laminar, or composite objects.

DETAILED DESCRIPTION OF THE INVENTION

The prior art contains a number of apparatuses utilized to radiate a surface for various purposes. These apparatuses usually comprise light and infrared (abbreviated hereafter as "IR") sources with various reflector arrangements for directing light toward a surface, for example a semi-conductor wafer surface. Examples of such apparatuses may be generally found in U.S. Pat. No. 5,561,735 to Camm et al.; U.S. Pat. No. 4,649,261 to Sheets; U.S. Pat. No. 5,279,973 to Suizu; U.S. Pat. No. 4,482,393 to Nishiyama et al.; U.S. Pat. No. 5,5155,336 to Gronet et al.; U.S. Pat. No. 4,981,815 to Kokoschke; and, U.S. Pat. No. 4,958,061 to Wakabayashi et al.

The radiation sources utilized in radiating a surface, particularly where rapid heating is desired, also come in various configurations and designs. For example, the source may be a high intensity radiation source such as a high powered inert gas arc. Such inert gas arcs are generally known in the art as shown in U.S. Pat. No. 4,027,185 to Nodwell et al., and U.S. Pat. No. 4,937,490 to Camm et al., which are incorporated herein by reference. The sources may be in the form of a tungsten-halogen or quartz-halogen heater. Tungsten-halogen and quartz-halogen heaters are known in the art as shown in U.S. Pat. No. 4,797,535 to Martin and U.S. Pat. No. 4,415,833 to Oetken et al., which are also incorporated herein by reference.

Although there has been an attempt to address the need for uniform surface radiating, there remains a need in the art for an apparatus which can provide high intensity radiation at controllable rates without sacrificing equipment.

Figure 1:
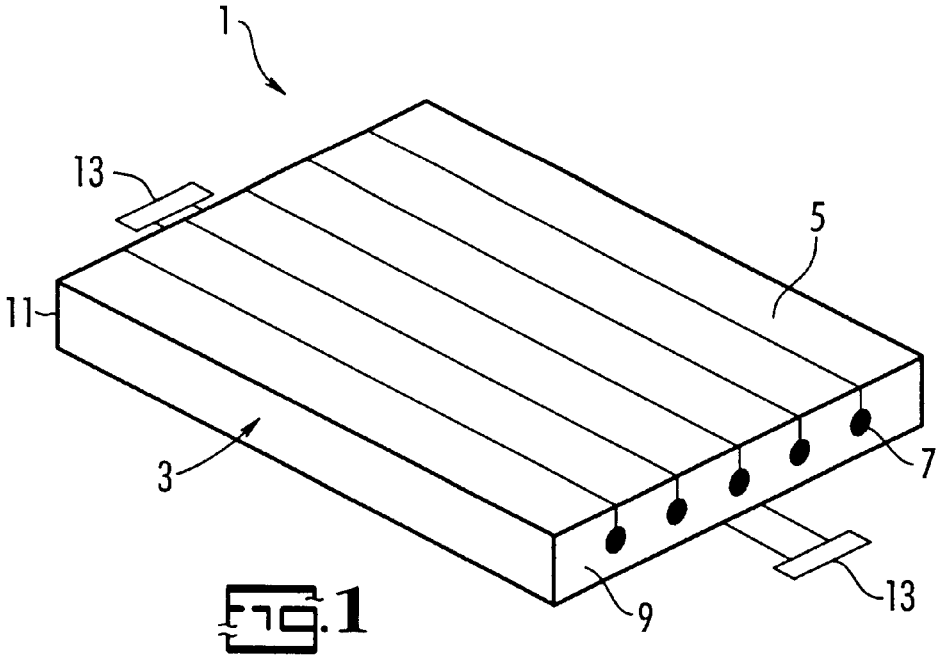
FIG. 1 is a diagrammatic illustration of an infrared heater capable of being used to emit unidirectional infrared radiation.

With reference to FIG. 1 of the present invention, a first embodiment of the IR heater 1 of the present invention is shown. The IR heater 1 may be a single-sided or double-sided apparatus having a generally flat or an arcuate diameter. The IR heater 1 may be designed to be portable or stationary, as desired and may be connectable to a system for providing a desired atmosphere between the heater and the object being heated, such as a vacuum or an inert atmosphere to prevent oxidation, e.g., of a metal surface.

As shown in FIG. 1, IR radiation source or IR heater 1 comprises a base 3 having a generally rectangular structure of varying dimensions. The IR source or heater 1 as shown is a generally planar array of IR radiation sources. The shape of the structure, however, may vary depending on the desired surface or area to be radiated. Base 3, is generally constructed of a metal or some suitable material. In a preferred embodiment, base 3 comprises a stainless steel. The interior surfaces of base 3 are preferably highly reflective surfaces. The interior surfaces may be coated with any highly reflective material, such as aluminum, for reflecting radiation from heat sources 5 toward an object. In a preferred embodiment, however, it is desired that the interior surfaces be gold-plated surfaces to enhance and extend the performance of the heater 1. The exterior surfaces of base 3 may or may not be reflectively coated.

A plurality of IR heat sources 5 are positioned generally within a plane of the base 3. The number of IR heat sources 5 will vary depending on the surface area of the die to be heated and the amount of heating desired. The heat sources 5 are generally powered through a controller (not shown) so that the power setting can be selected to obtain the desired heating rate. A controller, however, is not required for operation of the heater 1.

As shown in FIG. 1, heat sources 5 are secured within base 3 in a generally parallel fashion. The heat sources 5, which may comprise tungsten-halogen lamps or similarly suited devices, are connected to an electrical contact 7 by which power is supplied to the heat source 5. IR heating by use of the tungsten-halogen lamps is preferred in the present invention.

Positioned on at least two sides 9 and 11 of base 3 are hinge elements 13. Hinge elements 13 may be used for rotating IR heater 1 by at least 180 degrees. For instance, the heater 1 may be used to heat a top surface of a die and then rotated for heating a subsequent or bottom surface of the die. If large die blocks are being heated, however, a programmable computer control may be used to treat the top and bottom dies simultaneously. Heater 1 may further comprise carrying or moving means such as hooks, eyebolts, handles, wheels, and the like (not shown), attached in well-known ways, to aid in maneuvering the apparatus.

Figure 2:
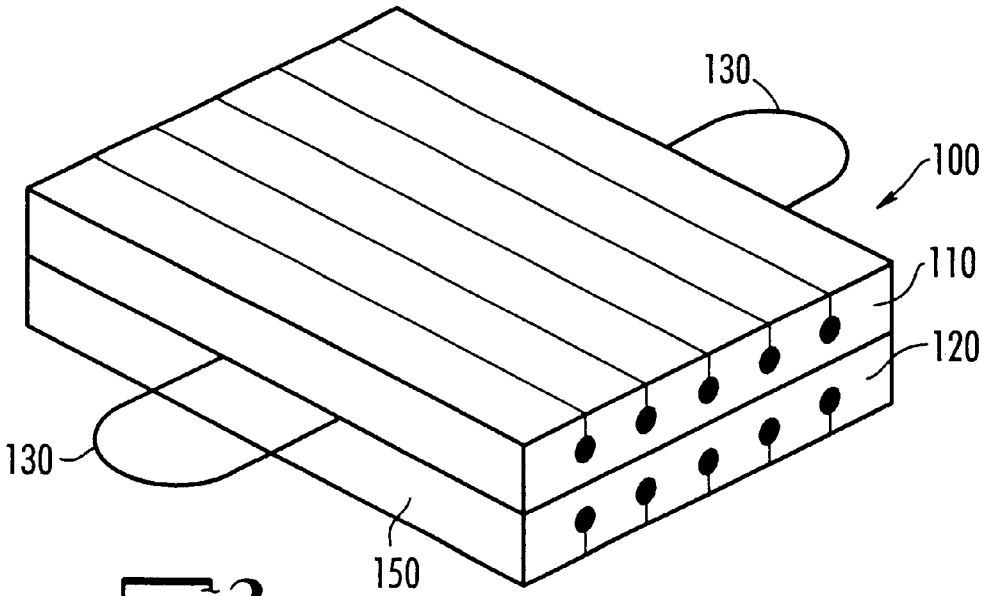
FIG. 2 is a diagrammatic illustration of an infrared heater designed to emit infrared radiation in at least two directions simultaneously.

With further reference to FIG. 2, a second embodiment of the present invention is shown. As seen in FIG. 2, an IR heater 100 comprises a combination of at least two IR heaters 110 and 120 joined such that a plurality of heating surfaces is provided. The two heaters 110 and 120 may be joined by any conventional means such that the heating surface of each heater 110 and 120 is disposed in a different direction. In a preferred embodiment of the invention, heater 100 is designed to be able to heat two objects simultaneously without requiring any rotation or computer manipulation or control. As further shown in FIG. 2, heater 100 comprises at least two hooks 130 for maneuvering. In certain instances, up to four hooks may be required for maneuvering the heater depending on the size and weight of the heater 100. Other means for moving or maneuvering heater 100, such as eyebolts, wheels, and the like, known to the art, may also be used.

The base member 150 of the second embodiment is similar to the base 3 of the first embodiment. The base is preferably constructed of a metal, such as stainless steel, and has highly reflective interior surfaces. The interior surfaces, again, may be coated with any highly reflective material, such as aluminum, for reflecting radiation from heat sources 5 toward a die. In a preferred embodiment, however, it is desired that the interior surfaces be gold-plated surfaces to enhance and extend the performance of the heater 100.

Figure 3:
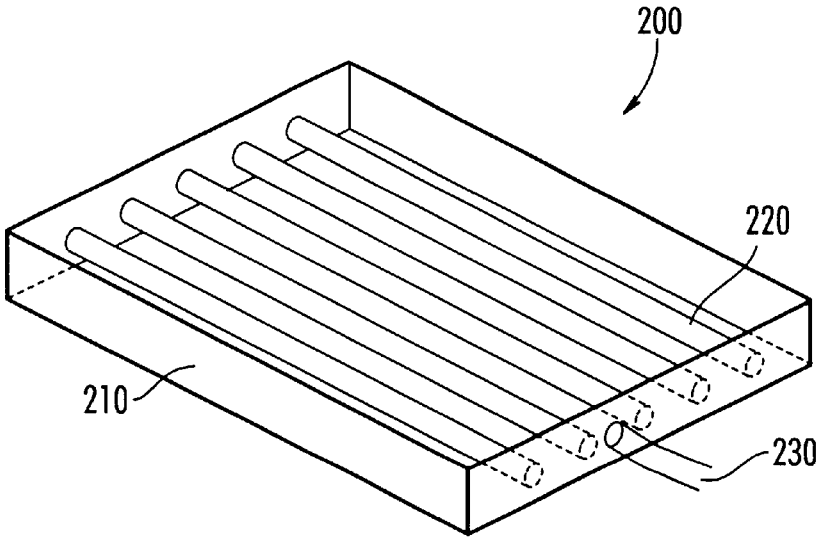
FIG. 3 is a diagrammatic illustration of an infrared heater utilizing tungsten halogen lamps in an inert atmosphere.

With reference to FIG. 3 of the present invention, a third embodiment of the present invention is disclosed. Consistent with the first and second embodiments, the third embodiment comprises an IR heater 200 having a base 210 of preferably stainless steel, or some other suitable metal. The base 210 supports a plurality of heat sources 220 which, in a preferred embodiment, comprise tungsten-halogen lamps.

The base 210 of the third embodiment is preferably cooled by a fluid, such as water. By cooling the base 210, heaters with relatively high power levels can be provided. As a general matter, IR heaters with power levels up to about 20 kW do not require separate cooling means. At power levels of over about 20 kW, use of a cooling system such as circulating water, or other systems known to those of skill in the art, provide protection and serve to increase the operational life of the sources.

Additionally, the heater 200 has an inlet 230 through which a gas is discharged to provide the heater 200 with a protective atmosphere capability. Such capability helps protect the surface being heated from adverse effects such as oxidation. The gas discharged into the heater 200 is preferably an inert gas such as argon. Alternatively, an active atmosphere such as a carburizing atmosphere for metal surfaces can be provided if desired.

Figure 4:
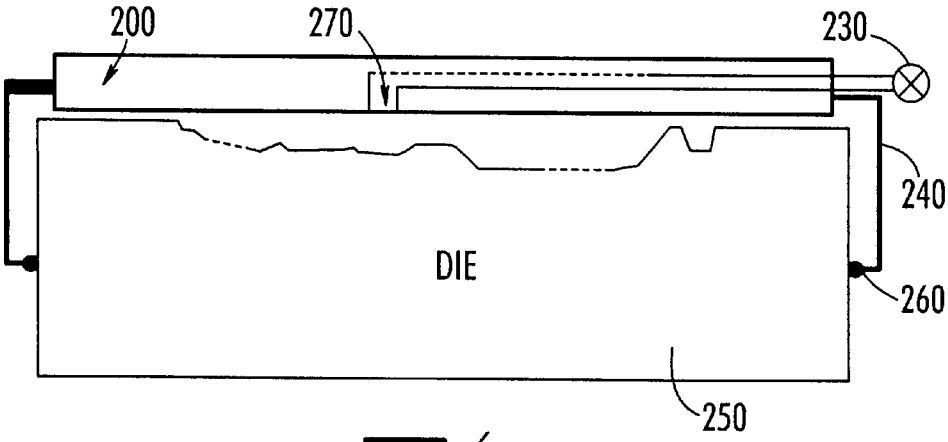
FIG. 4 is a diagrammatic illustration, viewed in cross-section, of an infrared heater positioned above a forging die face to be used in accordance with the current invention.

As schematically described with reference to FIG. 4, a particular use of IR heater 200 is illustrated. The IR heater 200 is placed over an object which is to be subjected to IR radiation for the purpose of altering a characteristic of the object. An enclosure 240, such as a cover or skirt, is attached to heater 200 and draped so as to enclose the object. Enclosure 240 can be made relatively airtight by use of a sealing means 260. The cavity is then filled with a gas via gas inlet 230. An outlet 270 located at a bottom surface of the heater 200 and in communication with the die 250 allows the gas to contact a surface of the die being restored. The enclosure 240 maintains the atmosphere over the surface of the die, the gas being chosen for any desired characteristic such as inertness.

Figure 5:
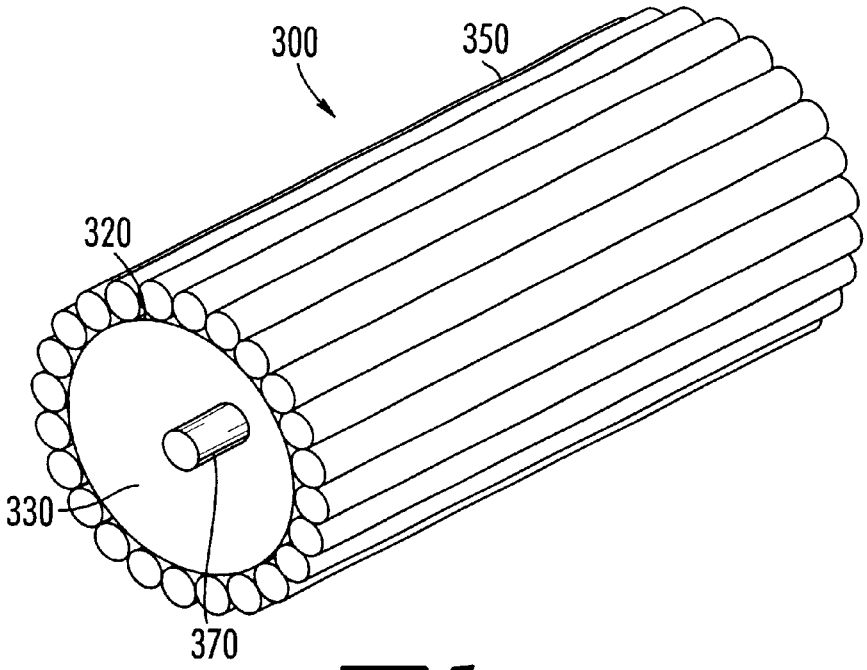
FIG. 5 is a diagrammatic illustration of an infrared heater designed to omnidirectionally illuminate a sample.
Figure 6:
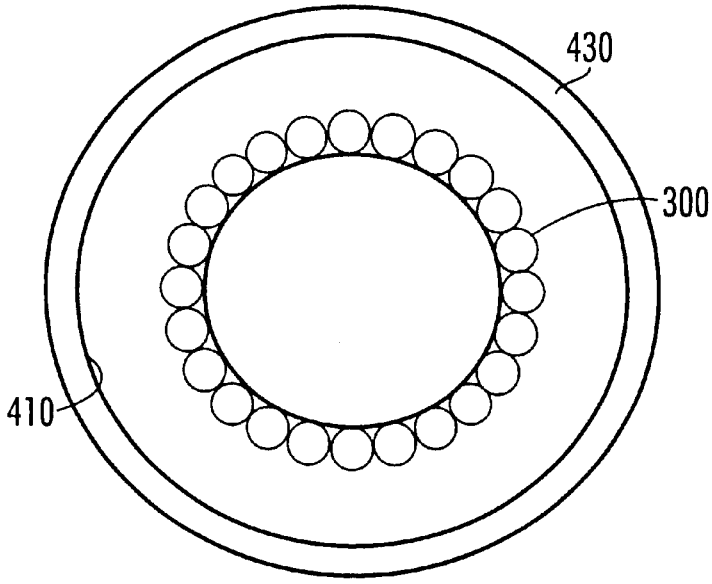
FIG. 6 is a cross-sectional view of the infrared heater shown in FIG. 5.

Referring to FIG. 5 and FIG. 6 of the present invention, a fourth embodiment of the present invention is disclosed. As seen in FIG. 5, an IR heater 300 is provided having a shell 320 defining an aperture 330. Heater 300 is generally circular, but may accommodate any shape which will allow a sample, such as sample 370, to be at least partially contained within aperture 330. Shell 320 is generally transparent to radiation and, thus, does not present a barrier to the radiation of heat sources 350 which surround shell 320.

As further shown in FIG. 6, heater 300 is surrounded on an exterior by a reflecting surface 430. Reflecting surface 430 is generally designed to accommodate the shape of the heater 300. The dimensions of the reflecting surface 430 are such that at least a majority of the radiation generated by heat sources 350 may be reflected back toward a center of the aperture 330 where the sample 370 is located.

Reflecting surface 430 is preferably coated on an interior surface 410 with a highly reflective material such as gold or some other suitable reflective material. In a preferred embodiment, the interior surface 410 of reflecting surface 430 is gold plated. Reflecting surface 430 is provided to direct radiation emitted by heat sources 350 back toward a surface of the sample 370. In addition, any radiation emitted by the sample 370 will, likewise, be reflected back toward the sample. Thus, the heater 300 provides for increased heating efficiency.

The IR heaters 1, 100, 200 and 300 shown in FIGS. 1–6 of the present invention can provide surface heating rates ranging up to 25° C. per second. The heating process of the present invention is termed "cold wall," meaning that only the specimen is heated to the desired temperature and not the assembly. This allows for near instantaneous starting and stopping of the IR heating assembly. In addition, the heating produced by the tungsten-halogen or quartz-halogen lamps is rapid, highly reproducible and can be delivered through a programmable computer control at efficiencies approaching 90%.

The current invention relates to the hitherto unrealized results and methodologies that can be obtained utilizing the very high heat fluxes and heating rates of the described apparatus. By controlling factors such as the heat flux and/or the heating rate and the exposure time, the current invention enables the treatment of only a layer or part of an object. It is thereby possible to effect a physical, chemical, or phase change in only a portion of an object.

In referring to a layer it is intended herein to refer to a portion of a monolithic, or homogeneous, object or to a discrete stratum such as a coating. Because the radiation effecting the desired change will typically impinge on a surface of an object, the affected layer is often referred to as a surface layer. Underlying the surface layer, either as an underlying portion of a monolithic structure or as a substance different from the surface layer, is a base layer.

In general, the current invention relates to utilizing the above described radiating apparatus to generate a heat flux of at least about 250 $kW/m^2$. Heating rates of up to about 200° C./s are possible. At these levels, it is possible to effect a change in a surface layer without effecting the same type or degree of change in the base layer. The effect may be one or more of several different types.

A physical change is involved in the sintering of metal particles. Conventionally, sintering is accomplished by layering metal particles or powder on belts, particularly Inconel belts. (Inconel is a trademark of International Nickel.) The belts carry the metal powder into a through a conventional electric furnace through a path of about 70 feet. About 60% of this length is necessary simply to bring the material to the sintering temperature of about 1200° C. While it is the goal of manufacturers to sinter at higher temperatures, e.g., 1260° C., this is not practicable because of the damage done to the expensive Inconel belts.

Using high heat flux IR sources, "green" metal powder can be effectively sintered at higher temperatures and in a shorter time without damaging the carrying belts. An IR furnace operated at only 66% power can produce heating rates of about 25° C./s for the metal. The material can thus be heated to sintering temperature in about 44 seconds. Even allowing for the necessary soak and transport time, use of this novel methodology will vastly increase production rates.

The capability of using the IR furnace at less than its full capacity represents a significant savings. Heat flux from an IR source is proportional to the fourth (4th) power of the source temperature. In a typical IR heater, the source may be a tungsten filament. Operating at or near 100% of the highest power for the source results in a typical service life of about 5,000 hours. Operation at less than 100% power dramatically improves the service life of a tungsten filament. At about 66%, for example, the service life of a typical tungsten filament will increase from about 5,000 hours to about 20,000 hours. This four-fold increase in service life represents significant savings in equipment replacement, service time, and associated expenses.

In such a sintering operation, the "green" metal serves as the surface layer, with the Inconel belts forming the base layer. A unidirectional IR source impinging upon the powder can heat the powder to sintering temperature. Because the heat is unidirectional, the belts are not enveloped in heat as in the case of conventional sintering furnaces. It is therefore possible to achieve sintering temperatures of 1260° C., achieving full densification, without damaging the belts.

Moreover, while staying within an effective IR spectrum, it is possible to "tune" the radiation. The sources can thus be tuned to a wavelength that is absorbed by the metal to a greater degree than it is absorbed by the belt material. In combination with the high heat flux and the shielding effect of the powder itself, the physical change of sintering is induced in the powder but not in the belts. The differences in absorption can be enhanced by including in the powder some proportion of substances having high absorbances for the IR spectrum being utilized.

EXAMPLE 1

Figure 8:
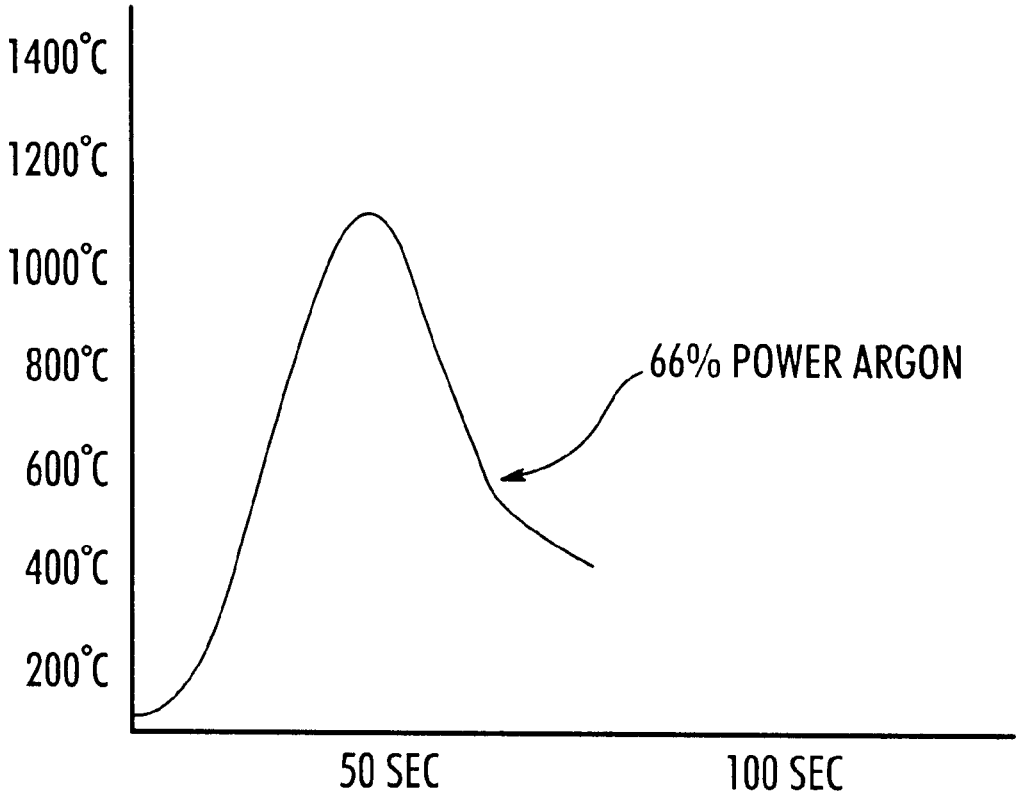
FIG. 8 is a graph of an infrared temperature cycle for sintering green metal powder.

A ⅛" layer of green metal powder was exposed to a flat panel IR source in an 80 kW system operated at about 66% of total available power. The sintering was done in an argon atmosphere, with a peak temperature of 1200° C. The IR (IR) temperature cycle is shown in FIG. 8. FIG. 8 is a graph of temperature as a function of time, the curve being measured at 66% power in an argon atmosphere. Metallographic examination of the strip following the completion of the IR cycle demonstrated that a substantial degree of the initial porosity had been eliminated even after this short cycle.

The methodology of the current invention can also be used to induce chemical and phase changes in a surface layer while leaving a base layer intact. Using IR heating according to the current invention can achieve such changes in a shorter time and at a much lower cost than conventional methods.

Decontamination of concrete surfaces at nuclear, biological, and chemical facilities is time-consuming and expensive. Several methods exist, ranging from mechanical methods such as scraping, grit blasting, or impaction as by jackhammers, to methods such as laser ablation, microwave scabbling, and biological methods. Each of these methods has severe drawbacks. All of them are slow and expensive. The mechanical methods generate a large amount of dust and debris which is difficult to capture, creating a hazardous environment. Biological and chemical methods such as gels, strippable coatings, and solvents require expensive systems for solvent decontamination and recycling and thus far are limited to contamination at the outermost surface of the concrete. Laser ablation and microwave scabbling require highly expensive equipment and can treat only small portions at a time.

According to the current invention, concrete surfaces can be decontaminated by the controlled removal of a surface layer, without damaging an underlying base layer. A planar array of IR sources such as quartz-halogen lamps provides heat fluxes of up to about 1000 $kW/m^2$. This level of flux heats the surface layer of the concrete, a depth of about 3 mm., to about 800° C. in 10 to 15 seconds. Deeper penetration and higher temperatures are possible, depending on the amount of power supplied.

The effect of this rapid, controlled heating is to vaporize substantially all of the water in the surface layer of the cement or concrete. This includes all of the conventionally evaporable water, the strongly absorbed water, and the chemically bound water binding the concrete. The rapid conversion of this water to vapor produces controlled spallation of the concrete. The use of higher temperatures decomposes the cement gel (calcium silica hydrate) and calcium hydrate.

The method enables highly controllable stripping or decontamination of surfaces. For example, a heat flux of about 500 $kW/m^2$ produces a temperature of about 800° C. to a depth of about 2.5 mm. in about 15 seconds. Adjusting the flux level and/or the exposure time allows fine control of the depth of the spallation achieved.

Figure 7:
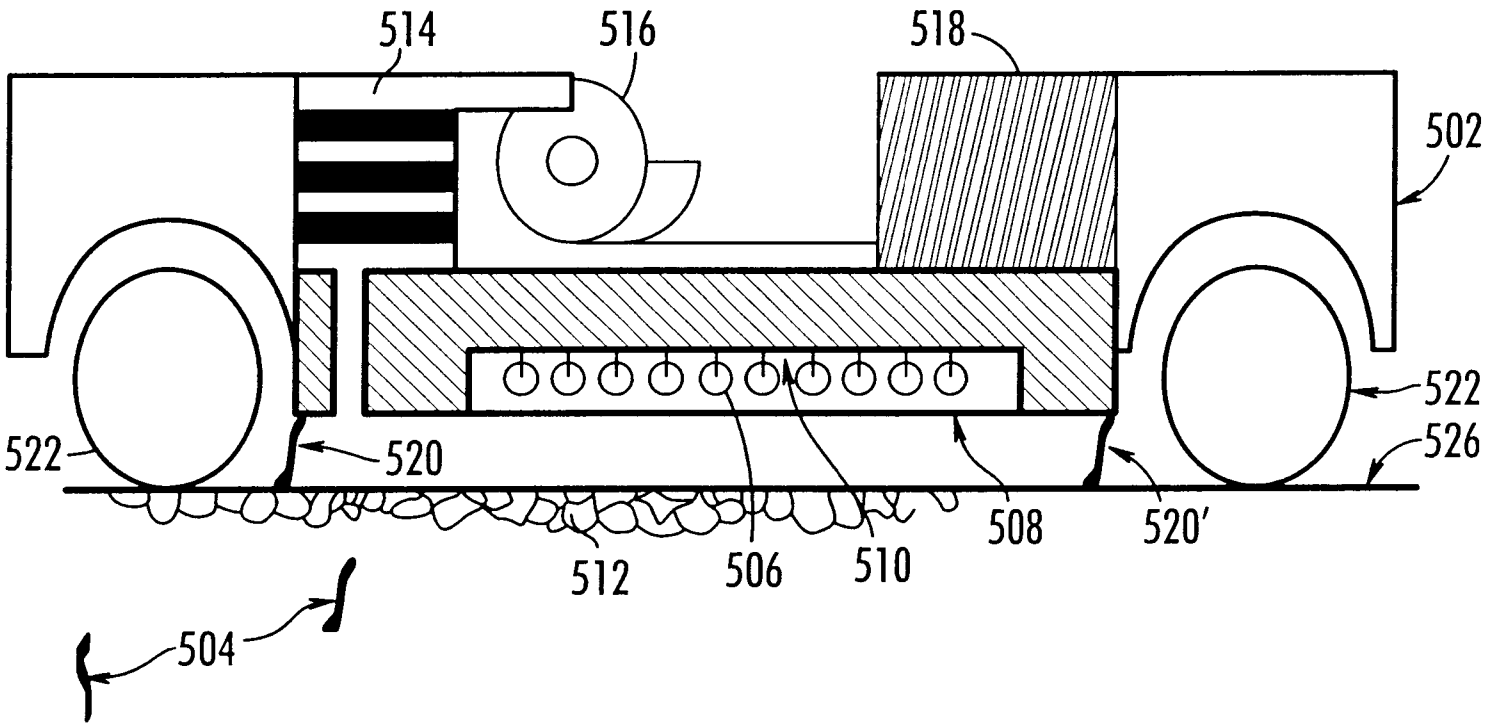
FIG. 7 is a diagrammatic illustration of an infrared heater system for removing surface layers from concrete materials.

Utilizing the methodology of the current invention also enables the use of an apparatus adapted to accomplish the decontamination. FIG. 7 illustrates an apparatus according to the current invention. A mobile platform such as cart 502 is provided with a transport means such as wheels 522 and a conventional motor (not shown). A power supply 518 can be carried on cart 502 to provide power to all components of the apparatus, or the apparatus can be remotely powered.

Cart 502 is provided with a planar array of high intensity IR lamps, an exemplary one of which is lamp 506. Radiation from the array passes through a quartz cover plate 508 and impinges on a concrete surface 526. Surface 526 is the upper layer of concrete material 504, which may for example be the floor of a nuclear facility. Virtually all of the radiation from lamps 506 strikes the surface 526 due to reflector 510. Reflector 510 can be a substance such as gold to efficiently reflect the IR radiation. The panel array can supply heat flux levels from about 250 to about 1000 $kW/m^2$.

In accordance with the current invention, lamps 506 are energized to the desired level. The IR radiation impinges on surface 526 of material 504. The high intensity radiation and the speed with which a high temperature is reached achieves rapid evaporation of the evaporable, strongly absorbed, and chemically bound water in the surface 526. Surface 526 crumbles due to spallation and decomposition to a crumbled layer illustrated at 512 in FIG. 7. The depth of layer 512 depends on the energy level of the lamps 506 and the dwell time, or duration, of the radiation. The depth of layer 512 can thereby be carefully controlled.

Cart 502 is also provided with a containment and collection system, many types and combinations of which are known to the art. One system illustrated in FIG. 7 consists of a filter system 514 and an air blower 516. Blower 516 is powered by supply 518 or by a remote source.

Extending between the lower part of cart 502 and the surface 526 is provided a containment system which can consist, for example, of curtains 520, 520'. The curtains may be continued and extended (not shown) to form a full skirt surrounding the area of surface 526 being treated by lamps 506. The curtains or the skirt prevent escape of dust or particles from layer 512, and contain the particles such that air from blower 516 is circulated between the curtains and into filter 514 where the particles are removed.

Cart 502 may be moved manually, or the drive system may be powered. Conventional steering and other controls can be mounted on cart 502, depending on its size and intended purposes Alternatively, the system may be supplied with communications system allowed remote control of all of its operations.

While the forgoing disclosures specifically refer to cement, or concrete incorporating cement, it is equally intended to include application to any cementitious material. As used herein, cementitious material refers to any material which can be decomposed by a heat-induced phase change in at least one component of the material.

The use of the current invention to use high intensity IR radiation to produce rapid, yet spatially limited, heating is accomplished with relatively low cost, easily available components. The resulting decontamination is thus relatively inexpensive. It is also very rapid, is effective over a much larger area than, for example, hammering or laser ablation, and leaves a relatively smooth even base layer. In view of the vast surface area currently needing decontamination, this methodology represents a significant savings in time and money.

The current invention also relates to the heat treating of the surface layer of metals. The use of high intensity radiation which can be precisely controlled and rapidly switched on and off permits novel methods of treating metals to enhance the utility and lifetime thereof.

Metal forging is currently the most common method of producing net shape or near-net shape objects from metal stock, especially steel stock. In a typical process, a billet such as from steel bar stock, is heated to a temperature of about 1100 to about 1200° C. The billet may be slightly preshaped. The billet is placed under a single forging die or between two die which have been reverse cut or molded to the desired shape. The billet is compressed by or between the die to impose the desired net shape.

Specialized steel alloys are used as the forging dies in such processes. Typical die materials are, by way of example, H-11, H-13, Extendo-Die™ alloy, and FX® alloy. (Extendo-Die™ is a trademark of Carpenter Steel; FX® is a trademark of A. Finkl & Sons.) For efficient use, these materials must be hardened to achieve a hardness in the range of $R_c$ 40 to 50. The method of achieving this hardness is by heat treatments to normalize or temper and quench the material.

While the hardness induced in the forging dies is necessary for forging, it has an adverse impact on the toughness of the material. At the hardnesses used in forging, the material toughness is in the range of 6.555 to 20.325 J (5 to 15 ft.-lb.). At this toughness, there is a risk of die failure under forging conditions, especially in high-impact, or hammer, open-die forging. The material is subject to cracking. While some slight cracking at the surface does not necessarily render the forge die unusable, the fact that the entirety of the die is of low toughness allows a crack to propagate throughout the die, rendering it useless. If the hard surface were backed with a base layer of high toughness, however, such propagation would be negligible or at least much slower. It is thus desirable that a forge die have a surface with high hardness and a base layer with high toughness. This is very difficult and highly expensive using current methods.

According to the present invention, however, the characteristics of the surface layer of a forge die can be changed without inducing the same type or degree of change in the base layer. Thus a forging die with a high hardness forging face and high toughness body can be produced.

In this aspect of the invention, a unidirectional IR heating system is used. The system is capable of high heat fluxes, achieving very high heating rates. The IR source used here is tungsten-halogen lamps arranged in an array calculated to maximize heat transfer to the desired surface. For a generally planar die face, a generally planar array is used, while other die shapes may be more amenable to an arcuate or other shaped array.

The IR source is capable of heating rates of up to about 200° C./min. At this rate and with a unidirectional heat source, in contrast to a conventional oven or furnace, a surface layer of the die block can be heated to a hardening temperature of from about 800 to about 1050° C. At this heating rate, the surface temperature is achieved while the base layer, or rear of the die in this case, remains essentially at room temperature.

The heating creates a gradient of temperatures from the surface layer to and through the base layer. The gradient can be controlled simply by controlling the length of time the IR source is allowed to irradiate the die. Quenching the die with the temperature gradient results in a proportionate gradient density, with the highest hardness at the face of the die on which the radiation directly impinged, and the lowest, or no induced hardness, at the base layer. The toughness of the die will be nearly proportional to the hardness, that is, the base will retain its toughness.

EXAMPLE 2

Figure 9:
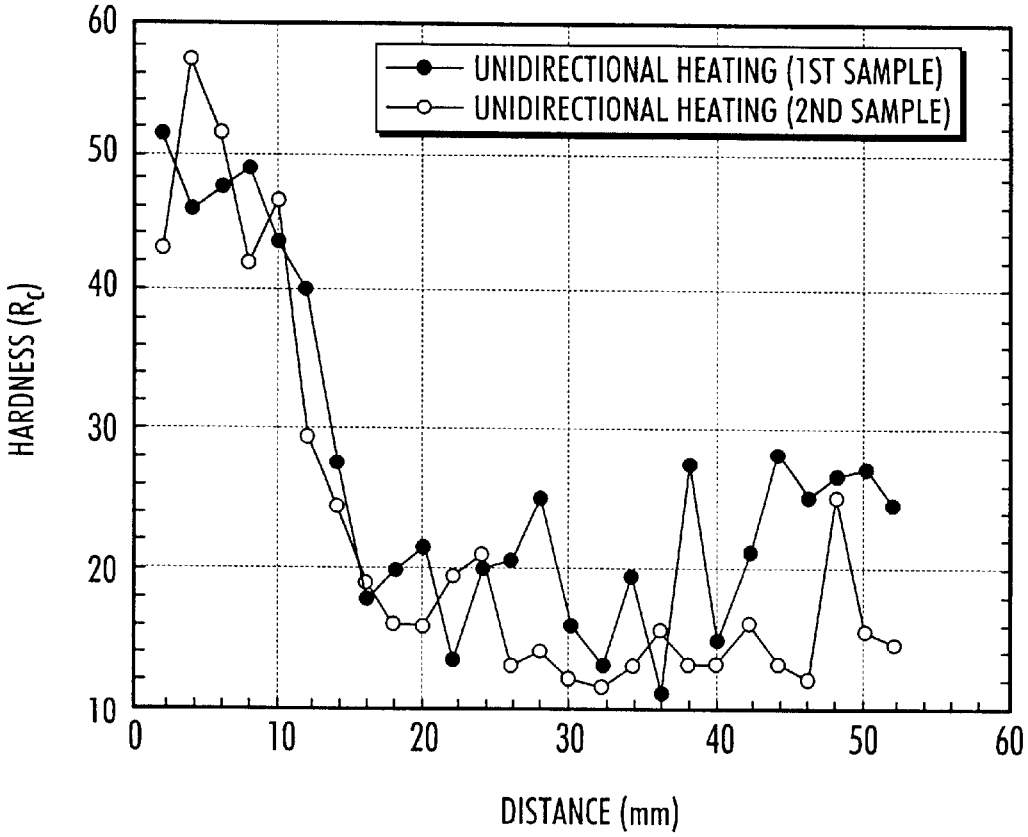
FIG. 9 is a graph of metal hardness as a function of distance from a surface for a metal block treated according to one aspect of the invention.

A 2-in.×2-in.×3-in. (5-cm.×5cm.×7.5-cm.) block of Extendo-Die™ material was unidirectionally heated in an IR furnace using tungsten-halogen sources. The atmosphere of the furnace was controlled to avoid unwanted reactions. Table 1 provides the chemical composition of this material. A surface temperature of 1030° C. was reached in 10.0 minutes. The material was water quenched and cut into two pieces. Hardness was measured as a function of distance from the surface exposed to the IR sources. The hardness data is presented in Table 2. FIG. 9 is a graph of the data shown in Table 2, showing hardness ($R_c$) as a function of distance in millimeters from the irradiated surfaces of the block. Data for the first sample is shown by the line with solid circles. Data for the second sample is a line with open circles.

TABLE 1

Chemical analysis of Extendo-Die ™ steel

| Element | Weight percent |
|---|---|
| C | 0.44 |
| Mn | 0.45 |
| Si | 1.00 |
| Cr | 6.00 |
| V | 0.80 |
| Mo | 1.90 |
| Fe | [a] |

[a]Balance.

TABLE 2

Hardness data on two surfaces of Extendo-Die ™ block after gradient heating by infrared source and water quenching.

| | Surface 1 | | Surface 2 | |
|---|---|---|---|---|
| Date Points | Distance (mm) | Hardness ($R_c$) | Distance (mm) | Hardness ($R_c$) |
| 0 | 2.0 | 51.5 | 2.0 | 43.0 |
| 1 | 4.0 | 46.0 | 4.0 | 57.0 |
| 2 | 6.0 | 47.5 | 6.0 | 51.5 |
| 3 | 8.0 | 49.0 | 8.0 | 42.0 |
| 4 | 10.0 | 43.5 | 10.0 | 46.5 |
| 5 | 12.0 | 40.0 | 12.0 | 29.5 |
| 6 | 14.0 | 27.5 | 14.0 | 24.5 |
| 7 | 16.0 | 18.0 | 16.0 | 19.0 |
| 8 | 18.0 | 20.0 | 18.0 | 16.0 |
| 9 | 20.0 | 21.5 | 20.0 | 16.0 |
| 10 | 22.0 | 13.5 | 22.0 | 19.5 |
| 11 | 24.0 | 20.0 | 24.0 | 21.0 |
| 12 | 26.0 | 20.5 | 26.0 | 13.0 |
| 13 | 28.0 | 25.0 | 28.0 | 14.0 |
| 14 | 30.0 | 16.0 | 30.0 | 12.0 |
| 15 | 32.0 | 13.0 | 32.0 | 11.5 |
| 16 | 34.0 | 19.5 | 34.0 | 13.0 |
| 17 | 36.0 | 11.0 | 36.0 | 15.5 |
| 18 | 38.0 | 27.5 | 38.0 | 13.0 |
| 19 | 40.0 | 14.5 | 40.0 | 13.0 |
| 20 | 42.0 | 21.0 | 42.0 | 16.0 |
| 21 | 44.0 | 28.0 | 44.0 | 13.0 |
| 22 | 46.0 | 25.0 | 46.0 | 12.0 |
| 23 | 48.0 | 26.5 | 48.0 | 25.0 |
| 24 | 50.0 | 27.0 | 50.0 | 15.5 |
| 25 | 52.0 | 24.5 | 52.0 | 14.5 |

The surface hardness of the block exceeded $R_c$ 50 as shown by the data. High hardness figures are maintained for nearly 10 mm, a distance which can be increased by increasing the holding time in the IR furnace. Between 10 and 20 mm., a gradient of hardness is observed, with the remaining material maintaining its original hardness values of $R_c$ 10 to 20.

The pieces of the block were then subjected to a tempering treatment. The pieces were placed in the IR furnace and maintained at a temperature of 585° C. for 1 hour. The pieces were then air cooled. Table 3 shows the hardness data for the tempered sample. The data shows that the as-quenched hardness near the surface and

TABLE 3

Hardness data on one surface of Extendo-Die ™ block after gradient heating by infrared source, water quenching, and a tempering treatment at 585° C. for 1 h in an infrared furnace

Figure 10:
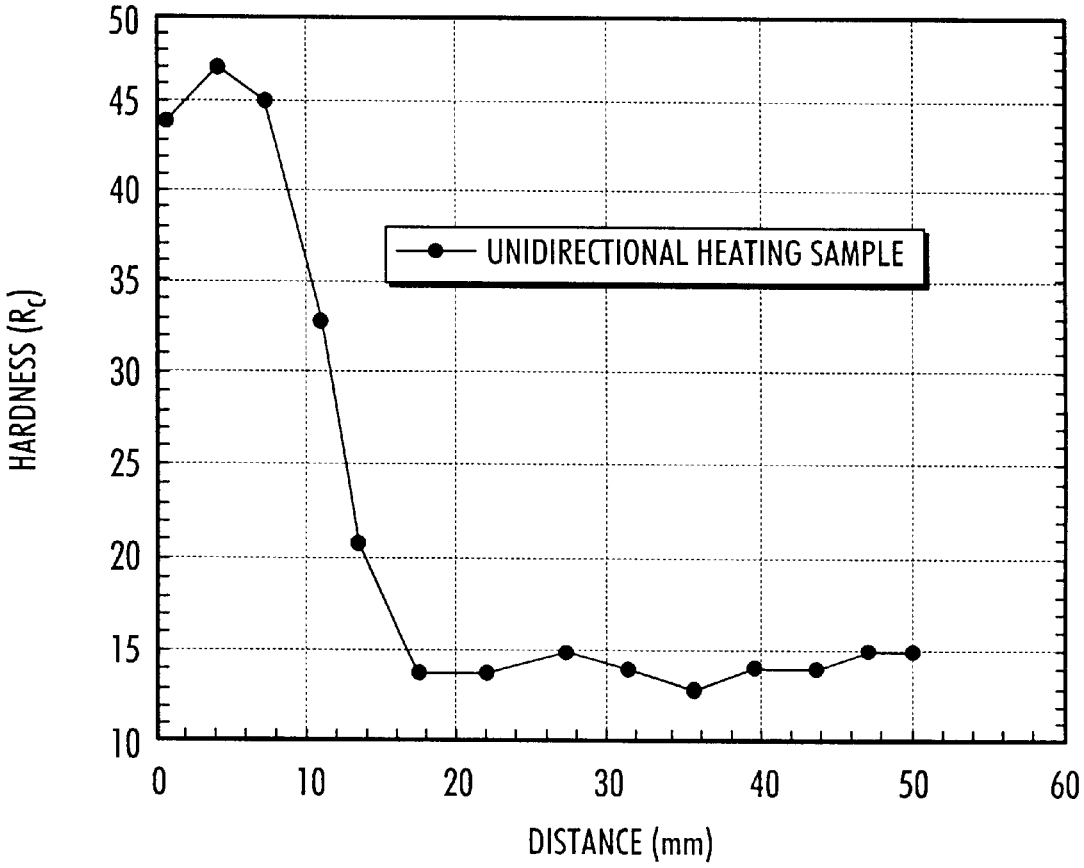
FIG. 10 is a graph of metal hardness as a function of distance from a surface for a metal block treated according to one aspect of the invention followed by a tempering treatment.

| Data points | Distance (mm) | Hardness ($R_c$) |
|---|---|---|
| 0 | 0.80 | 44.0 |
| 1 | 4.24 | 47.0 |
| 2 | 7.40 | 45.0 |
| 3 | 10.75 | 33.0 |
| 4 | 13.12 | 21.0 |
| 5 | 17.00 | 14.0 |
| 6 | 21.40 | 14.0 |
| 7 | 26.90 | 15.0 |
| 8 | 31.15 | 14.0 |
| 9 | 35.24 | 13.0 |
| 10 | 39.20 | 14.0 |
| 11 | 43.23 | 14.0 |
| 12 | 46.80 | 15.0 |
| 13 | 50.00 | 15.0 |

in the gradient region drops by about 5 points. This data is plotted as a function of distance from the irradiated surface in FIG. 10.

Using mechanical data from the manufacturer relating changes in strength and ductility relative to changing hardness, the tensile strength and ductility properties of the above-treated sample were estimated. The estimated data is set forth in Table 4.

TABLE 4

Estimated tensile properties of Extendo-Die ™ block based on hardness achieved in the sample of this invention.

| Distance (mm) | Hardness ($R_c$) | Yield strength (ksi) | Ultimate tensile strength (ksi) | Total elongation (%) | Reduction of area (%) |
|---|---|---|---|---|---|
| 0.8 | 44 | 193 | 220 | 11.0 | 37 |
| 4.24 | 47 | 205 | 240 | 9.0 | 32 |
| 7.40 | 45 | 195 | 225 | 10.0 | 35 |
| 10.75 | 33 | <140[a] | <180[a] | >22.0[a] | >45[a] |

[a]Extrapolated from values at approximately $R_c$36.

The data in Table 4 demonstrate that the induced gradient in hardness causes a proportional gradient in strength and ductility. In the sample, ductility increases from about 10% near the surface to over 20% at only about 10.75 mm below the surface of the block. This increase in total elongation can be expected to have the corresponding increase in impact toughness. Thus, the gradient induced by the current invention provides hardness on the surface where it is most desirable for wear resistance and precision in forging. Despite the high surface hardness, the gradient leaves high toughness characteristics in the base layer to provide resistance to crack propagation and die failure.

Current methods of providing surface hardness typically involve simply using a gas jet or the like to heat the surface. This method does not allow a controlled atmosphere and generates a high amount of waste heat. Additionally, it is a time-consuming process and does not provide an even, controlled heat over the entire surface of the die. A gas jet applied too long in one area and not long enough in another not only does not induce the same hardness in the two areas, but creates another source of stress in the surface resulting from the differing hardnesses. The method of the current invention avoids these and other problems.

Even a forge die treated as above to provide good hardness and toughness characteristics is subject to wear during the forging process. During the process, the heat of the billet is transferred to the forging die or dies. This results in overtempering of the die surfaces and the die surfaces soften. Such overtempering alters the dimensions of the die, and hence of the shape to be imposed on the billet, and causes the die to deform.

It is an aspect of the current invention to prevent, or greatly slow, the gradual failure of a forge die due to overtempering. There is provided a method for restoring the surface hardness of a forge die. This has the advantage of greatly extending the life of the die, and has the added advantage that in many cases the die will not have to be removed from the production line.

In accordance with the invention, a generally planar array of tungsten-halogen IR sources is provided. This array can be typically mounted in a stainless steel body which can be water cooled. Also, there can be provided an evacuation tube for the introduction between the array and the die surface of a controlled, e.g., inert gas, atmosphere.

Restoration of the surface hardness is accomplished by placing the array on or near the surface of the die. The array is energized for a period of time sufficient to raise the die surface to the austenitizing temperature for the particular allow comprising the die. This temperature is held for an appropriate amount of time, for example, 2 to 10 minutes. The die surface is then air cooled or water quenched. Such heating restores the hardness of the die face to hardnesses in the range of about $R_c$ 45 to 55. If desired, the same array can be used to temper the surface.

To further condition the die surface, or to prevent a change in the chemistry of the die material through oxidation or decarbuization, a controlled atmosphere can be introduced over the die face during the above process. A skirt of suitable material is secured to the array and draped around the die as shown in FIG. 4. A suitable gas is introduced through inlet 230. The skirt 240 can be sealed as at 260 to maintain the atmosphere, or the seal can be partial, the atmosphere being maintained by a slight positive pressure of gas through inlet 230. An inert gas can be used to simply prevent oxidation. Introduction of a carburizing, nitriding, or boronizing gas, depending on the die material and the desired effect, will greatly increase the life of the die.

The foregoing process can be repeated as necessary. It can be done with the die in place, and the speed of the process is such that it could easily be accomplished during shift changes. The fact that a unidirectional, highly controlled IR source is used eliminates the need to remove the die and place it in a conventional furnace. Also because of the directionality of the radiation and the high heat fluxes, little or no protective barriers are necessary during the restoring process.

A related use for the flat panel array relates to another aspect of the invention. Forging dies operate best when they are preheated prior to beginning the forging process. Relatively cold, or room temperature, dies have poor toughness characteristics. If used at this temperature, the surfaces are highly susceptible to cracking. To avoid this, the die surfaces are preheated.

Current preheating methods are highly inefficient. Typical methods involve applying heat via a gas jet, such as a torch, or placing a preheated metal block next to the die surface. The former method is haphazard and time-consuming, while the latter is timeconsuming and wasteful. The metal block of the latter method loses a much of its heat to the surrounding area, and must be periodically reheated. Moreover, transferring such a block from die to die is an inconvenient process.

By a method according to the current invention, preheating the die surfaces is achieved quickly and precisely. An array of IR sources is used to provide a high heat flux capable of preheating the die forging surfaces in a matter of seconds. An array, either in flat panel formation or in a shape designed for the particular dies, is placed on or near the die surface. The sources are then energized, and rapidly heat the surface to the desired preheating temperature.

The source as shown in FIG. 1 can be used for single die faces. Alternatively, utilizing the hinges shown at 13 in FIG. 1, the array can heat one of two facing die surfaces, then rotated and used to heat the other. An alternative is illustrated in FIG. 2, wherein two arrays are arranged to simultaneously heat two surfaces. The apparatus shown in FIG. 2 assumes two directly facing surfaces, but the two arrays can be angled or curved to match the die contours and relative positions.

Figure 11:
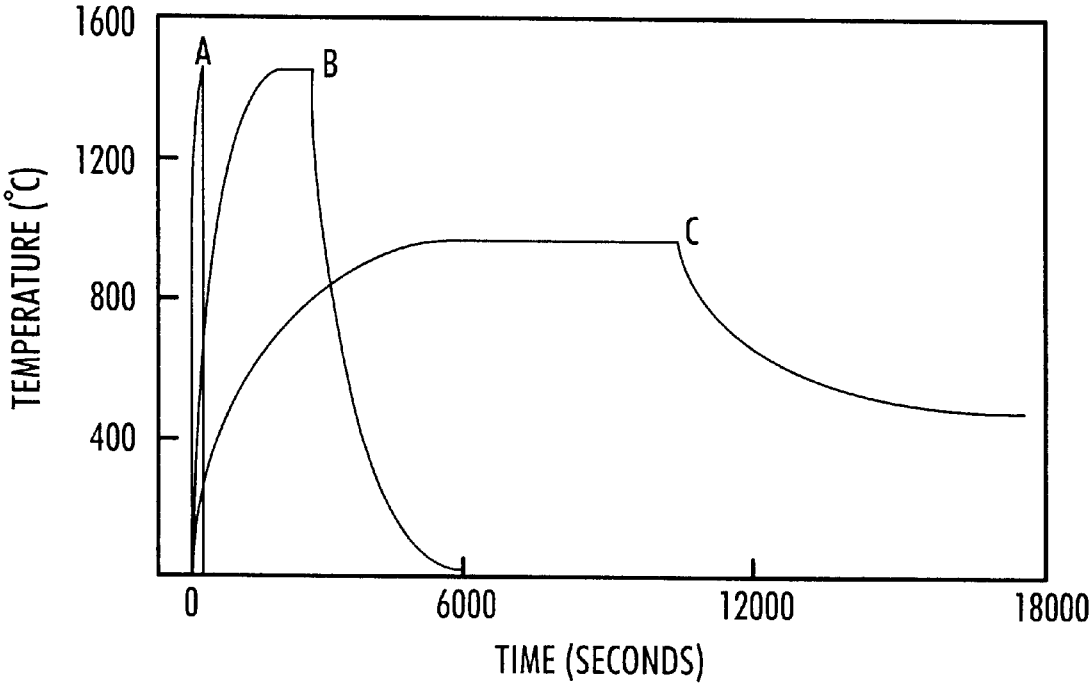
FIG. 11 is a graph of exemplary heating rates for different methods of heating an object.

A comparison of preheating methods is provided in FIG. 11. FIG. 11 is a graph that relates temperature to time for IR heating (Curve A), induction heating (Curve B), and resistive heating (Curve C). Infrared radiation according to the current invention is clearly the quickest, most effective, and most controllable of the methods.

To illustrate the advantages of this method, a 2-in. (5-cm.) diameter bar of 4340 steel was heated in a tubular IR system as shown in FIGS. 5 and 6. The surface temperature of the bar was raised to 1200° C. Heating efficiency calculations, which provide the ratio of the energy required to heat a material to a desired temperature to the energy supplied by the source, indicate that the methodology of the current invention provides efficiencies of nearly 90%.

The current invention provides many advantages over other types of heating methods and apparatus in addition to those already mentioned. For example, the use of induction heating is limited to electrically conductive materials, and cannot-be used at all on materials such as ceramics. An object partially made of nonconducting materials is subject to damage during inductive heating due to uneven temperatures. Moreover, induction heating is generally limited in use to simple and/or geometrically symmetrical shapes, due in part to the need to achieve even heating. Even heating is difficult or impossible for asymmetric, complex shapes. Finally, the capital costs for induction heating are relatively high.

In contrast, IR heating in accordance with the current invention can be used with any material whether conductive (e.g., metals), nonconductive (e.g., plastics or cement), or even insulative (e.g., ceramics). Because the IR sources are radiating sources, IR heating can be used on material having any shape, however complex or simple. Also, and especially compared to inductive heating systems, IR heating systems are significantly less expensive, both in capital costs and in maintenance and repair costs.

In further comparison with induction and resistive heating, IR heating allows attainment of high temperatures in a fraction of the time required for inductive or resistive heating. Where necessary, an IR source can be shielded or masked so as to heat only a desired portion of a surface, and surrounding areas can be effectively, simply, and cheaply shielded from the source.

Microwave heating is also limited as a practical matter to non-metallic surfaces. Moreover, microwave radiation heats the center portion of an object, with heat then being conducted outward until the object and/or its surfaces are at the desired temperature. At least in part due to this, microwave heating cannot be selectively applied to a surface or a portion of a surface of an object.

Again, IR heating according to the present invention overcomes all of these problems. IR heating is not limited to certain materials. It heats the surface on which it impinges and can be controlled so as not to heat a base layer or portion. This allows highly selective heating of surfaces or portions thereof.

Other heating systems, such as heating by gas furnace or torches, also have problems which are overcome by the use of the current invention. Gas heating is slow and, in the case of torches, is uneven. To avoid uneven heating, costly and bulky devices such as furnaces must be used, and furnaces do not solve the slowness problem. Gas heating devices are often polluting, or require cleaning systems to avoid pollution. Moreover, a significant amount of dedicated equipment such as tanks, plumbing, and safety devices and systems must be installed with gas devices, further raising the costs.

The IR heaters of the current inventor are very much faster than the gas devices. They are capable of even, fast heating. They require little if any associated equipment, utilize commonly available power sources, and produce no additional pollutants. These and other advantages are achieved by the methods and apparatus of the current invention.

The current invention provides a novel methodology of inducing a heat treatment of a surface layer without also treating a base layer. The central methodology can be used in differing ways, and can be used to produce material which formerly could be produced only under highly expensive, difficult, and time-consuming conditions. The methodology and advantages of the current invention can be utilized in a number of specific ways, but it is to be understood that the invention itself is limited only by the scope of the following claims.

What is claimed is:

1. A metal body comprising:

a surface layer having a surface face and a predetermined depth; and a base layer contiguous with said surface layer;

said surface layer having been hardened at least at said surface face by exposure to a source of infrared radiation capable of producing a heat flux of from about 250 to about 1000 $kW/m^2$ whereby said surface face was hardened by being heated at a rate of from about 100 to about 200° C. per minute and subsequently quenched.

2. A metal body according to claim 1, wherein said surface layer has a gradient of hardness from a relatively high hardness at said surface face to a relatively low hardness at said depth.

3. A metal body according to claim 2, wherein said surface face is a forging die face.

* * * * *